United States Patent [19]

Lunders

[11] Patent Number: 4,485,577

[45] Date of Patent: Dec. 4, 1984

[54] CAP COVER FOR PERCUSSION FIREARMS

[76] Inventor: R. Keith Lunders, P.O. Box 151, Elk River, Id. 83827

[21] Appl. No.: 394,549

[22] Filed: Jul. 2, 1982

[51] Int. Cl.[3] ..... F41C 27/00

[52] U.S. Cl. ..... 42/83

[58] Field of Search ..... 42/83, 1 N, 1 LP, 51

[56] References Cited

U.S. PATENT DOCUMENTS

| | | | |
|---|---|---|---|
| 19,213 | 1/1858 | Smith | 42/83 |
| 35,418 | 5/1862 | Haskins | 42/83 |
| 42,621 | 5/1864 | Lilly | 42/83 |
| 4,227,330 | 10/1980 | Chapin | 42/51 |

OTHER PUBLICATIONS

Bridges, Toby; "On the Game Trail"; *Muzzleloader Magazine;* Mar./Apr., 1983, pp. 21, 22.

Bridges, Toby; "Odds & Ends"; *The Buckskin Report;* pp. 6, 7, Jun./Jul. 1983.

*Black Powder Times;* "Safe-'n-Dry Cap Cover"; p. 35, Feb./Mar. 1983.

*Primary Examiner*—Charles T. Jordan

*Attorney, Agent, or Firm*—Wells, St. John & Roberts

[57] ABSTRACT

A removable cover for percussion cap firearms keeps the cap dry and allows the firearm to be carried in a fully cocked condition with no danger of accidental discharge. The cover can be quickly and silently removed from over the percussion cap at the time the weapon is to be fired. The cover includes an open ended bore that slidably receives the projecting length of the cap supporting nipple, hermetically sealing the cap within. The length of the bore is such that it's closed end is spaced clear of the cap when the open bottom end rests against the firearm. The hammer may accidently strike the cover but the striking force will be deflected to bypass the cap and be transmitted directly to the firearm breech area adjacent the nipple.

12 Claims, 4 Drawing Figures

CAP COVER FOR PERCUSSION FIREARMS

FIELD OF THE INVENTION

The present invention relates to selective covering of percussion caps on percussion type firearms for safety in preventing accidental discharge and for keeping the covered cap dry.

BACKGROUND OF THE INVENTION

In this age of advancing technical sophistication there is a growing interest to hold onto tradition, especially in sporting interests. "Black powder" enthusiasts exemplify this interest. They collect, hunt, and target shoot exclusively with antique style black powder firearms. Possibly the most popular black powder firearm that is in current use for hunting and target shooting is the "percussion cap" form.

A percussion cap is an explosive primer that fits over a "cone" or nipple projecting from the breech of the firearm in the swing path of an exposed hammer. The nipple includes a small bore leading into the firing chamber of the barrel. When the cap is struck by the hammer, powder within the cap flashes through the nipple bore to ignite the black powder in the firing chamber, discharging the firearm.

The percussion form of black powder firearm is preferred due to relatively consistent firing reliability, accuracy, and loading quickness advantages over even older style "flintlocks". However, firing reliability decreases significantly in damp weather. A wet percussion cap will not fire.

One solution to this problem has been to carry the percussion caps in a dry place and place one over the cone or nipple just prior to firing the weapon. This solution is often the direct cause of extreme agitation. Many a quarry has walked casually out of site or range while a fumbling hunter frantically tries to remember the location of that dry place; and then, remembering, proceeds to spill the whole store into a snowbank.

Another nemesis to the black powder hunter is the built-in advance game warning system incorporated in every black powder firearm . . . the hammer and cocking mechanism. To the black powder hunter, there are fewer greater handicaps given to the game than the sound of a hammer being moved to a cocked position. The sharp clicking sound of the sear and tumblers carries so well that any wary prey, not knowing better, would think a Sherman tank was approaching.

Obviously, a black powder hunter cannot safely carry his weapon in a fully cocked condition. The risk is just too great that the weapon might be accidentally discharged or, what is nearly as bad, misfire and require re-cocking.

Both of the above faults could undoubtedly be corrected by redesigning the percussion cap firing mechanism. The cap and nipple could be situated, for example, within a waterproof sealed access and the hammer mechanisms could be re-designed and encased in plastic sound-deadening materials. The result, however, would not be a true percussion firearm and much of the nostalgic and aesthetic value would be lost. Certainly, no self-respecting black powder enthusiast would even consider purchasing a percussion firearm having "plastic" parts or that did not at least look authentic. Such modern technology is just what the black powder enthusiast is avoiding by his sport. Besides, many hunting regulations are quite specific regarding allowable forms of black powder weaponry.

A real difficulty remains in overcoming the above problems while retaining the old world integrity and simplicity of percussion firearms. To the present inventor's knowledge, there has been no adequate solution and the problems have remained until the advent of the present invention.

BRIEF DESCRIPTION OF THE DRAWINGS

Preferred and alternate forms of the present invention are illustrated in the accompanying drawings in which.

DETAILED DESCRIPTION OF PREFERRED AND ALTERNATE EMBODIMENTS

In compliance with the constitutional purpose of the Patent Laws "to promote the progress of science and useful arts" (Article) 1, Section 8), applicant submits the following disclosure of the invention, illustrated by the embodiments shown in FIGS. 1 through 4.

Figure 1:
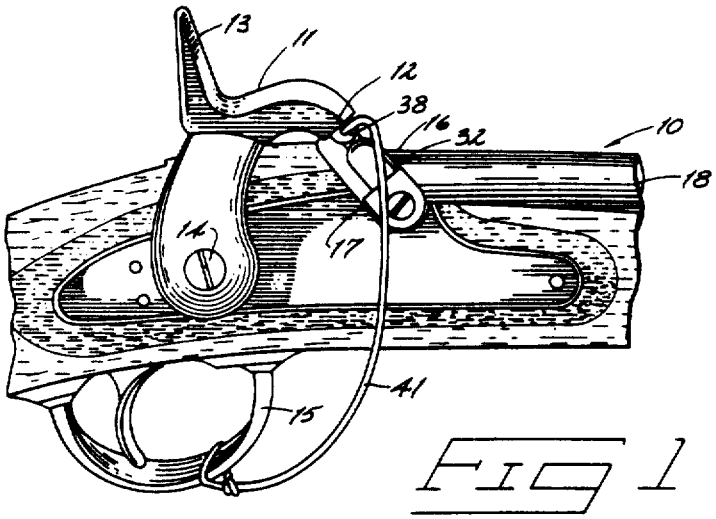
FIG. 1 is a fragmentary side elevation view of a percussion firearm with the present cover mounted thereto.

A portion of a "black powder" percussion cap firearm is shown at 10 in FIG. 1 of the drawings. For purposes of later description and to familiarize the reader with such firearms, a brief description is in order. The typical black powder percussion cap firearm 10 includes an exposed hammer 11. This hammer includes a striking surface or "countersink" 12 and an offset upwardly projecting cone 13. The entire hammer pivots about the axis of a tumbler screw 14 between a firing position as shown in FIG. 1 and a fully cocked position (not shown), wherein the striking surface 12 is spaced in an arcuate swing path centered on the tumbler screw axis from the firing mechanisms at the weapon's breech 16.

The typical percussion firearm includes a cone seat 17 at the breech 16. This area includes an internal bore leading into the firing chamber for the barrel 18. The breech 16 and cone seat 17 may be considered an integral part of the barrel 18.

Figure 3:
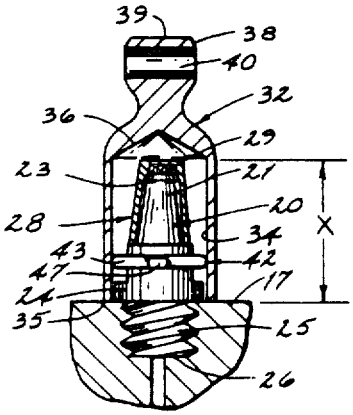
FIG. 3 is a sectional view of the cover with one form of seal means.
Figure 4:
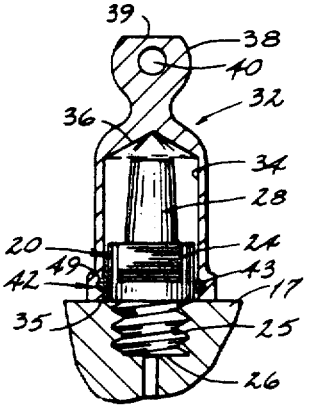
FIG. 4 is a sectional view of the cover with another form of seal means.

A "cone" or nipple 20 (FIGS. 3 and 4) is typically threaded into the cone seat 17. Nipples are illustrated in FIGS. 3 and 4. FIG. 4 illustrates a standard nipple 20 and FIG. 3 is illustrative of a modified nipple used in a preferred "kit" embodiment of the present arrangement. Both forms of nipple 20 include similar typical features. A conical nipple stem 21 (FIG. 3) is situated adjacent a top end 23. The stem leads to a head 24 that is usually provided with opposed flat surfaces for gripping by a nipple wrench. Threads 25 are located below the head 24 extending to a bottom end 26. The threads are received within a complementary threaded aperture in the cone seat 17. The nipple 20 may be threaded into the cone seat until the head 24 comes into abutment with the cone seat 17.

The nipple 20 is threaded to allow its replacement or removal for cleaning. Otherwise the small bore (not shown) leading through the length of the nipple can become clogged with burned powder and result in misfiring.

FIGS. 3 and 4 also show percussion cap 28. The cap 28 is shown in section in FIG. 3 and whole in FIG. 4. The cap 28 is slidably received over the nipple stem 21. It includes a small amount of percussion ignitable powder 29 in the closed base end thereof. The powder is situated over the top end of the nipple so when struck, the powder will flash through the central nipple bore and into the firing chamber of the barrel.

There are several different forms of standard nipples 20 on the current market and, consequently, several different sizes. However, all forms significantly resemble that shown in the drawings and described above. There is a relatively small variance of diameters and the distance of X as shown in FIG. 3 in which the nipple top end and cap project from the cone seat 17.

A basic element of the present invention is the cover shown generally at 32. Cover 32 is provided to be removably received over nipple 20 and may be useful to keep the associated cap 28 dry and to allow the firearm to be carried in a fully cocked condition without danger from accidental discharge. The cover 32 can be provided alone as shown in FIG. 2, as a kit along with a modified nipple 20 as shown in FIG. 3, or in the version shown in FIG. 4 incorporating an integral seal means that will be described more fully below.

Figure 2:
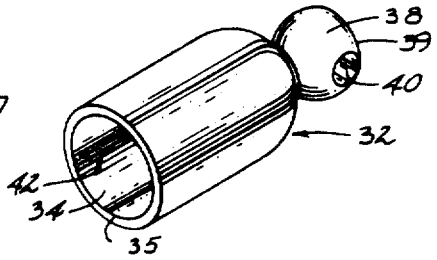
FIG. 2 is an enlarged pictorial view of the present cover.

The basic form of the present cover 32, as shown in FIG. 2, includes an internal bore 34. The bore 34 is dimensioned to be slidably received over the head 24 of a nipple. The size of the bore will be determined by the nipple size and tolerances such that the fit is snug.

The bore 34 extends from an open bottom end 35 to a closed top end 36. The distance between the open bottom end 35 and the closed top end 36 is greater than the distance X disclosed above. This assures that the closed top end 36 is spaced clear of the cap 28 and nipple top end 23 when the open bottom end 35 is situated at the cone seat 17.

A protrusion 38 may extend axially upward from the closed top cover end 36. The configuration of protrusion 38 facilitates gripping by the user and presents a striking surface 39 complementary to the striking surface "countersink" 12 of the hammer. The cover is constructed of a relatively soft malleable material, such as brass, that will deform on impact rather than damage the striking surface 12 of the hammer. Strength of the material, however, is sufficient to deflect or transmit the force of the hammer impact directly to the breech area 16, bypassing the cap. Therefore, if the trigger is pulled accidentally, the hammer will strike the cover 32 and the impact force thereof will be transmitted to the breech area 16 rather than the cap 28. The weapon can, therefore, be carried safely in a full cocked condition.

A bore 40 is formed transversely through protusion 38 in order to receive one end of a thong 41. The thong is preferably leather and extends to a free end for attachment to the trigger guard 15. The thong will prevent accidental loss of the cover 32 and facilitates a quick and silent movement to a firing condition. The shooter may simply pull the cover 32 from the nipple and drop it, letting it swing on the thong 41 while he aims and fires. The cover can be easily replaced later. The thong 41 allows the shooter to quickly be rid of the cover and prevents the cover from dropping to the ground or from obstructing the shooter's hand.

A seal means generally designated at 42 in the drawings may be provided for sealing the cap within the confines of the cover bore 34 to prevent moisture from getting to the cap. Several forms of seal means are illustrated. FIGS. 3 and 4 involve the use of an "O" ring 43. In FIG. 3, the "O" ring 43 is mounted to the nipple 20. In FIG. 4, the "O" ring 43 is mounted to the cover 32. In the basic version illustrated in FIG. 2, no "O" ring is shown. Instead, the seal means 42 if desired, may be considered as integral with the walls of the bore 34 and their snug engagement with the nipple head 24 to produce the seal. This "metal to metal" form of seal may be enhanced by a small amount of grease applied to the bore walls or to the cylindrical surface of the nipple head 24.

The preferred "kit" form illustrated in FIG. 3 provides the seal means 42 in the form of an "O" ring mounted to a modified nipple 20. In this manner, the basic form of the cover 32 can be used to seal against the "O" ring 42 which is kept as a part of the nipple 20. This version is preferably supplied in kit form since it is necessary to slightly modify the nipple with a groove 47 in which the "O" ring 43 seats.

The FIG. 4 version makes use of a standard nipple 20. Here, the seal means 42 includes an "O" ring 43 that is received within an internal annular groove 49 within the cover bore 34. The groove 49 and "O" ring diameter are such that the cylindrical surfaces of the nipple head 24 will be firmly gripped by the inside "O" ring surface, thereby sealing the cap area within the confines of the bore.

It is noted that the seal means "may" be provided, generally as some element coacting with the cover to hermetically seal the cap 28 from the outside environment. However, where state hunting regulations require constant exposure of percussion caps, appropriate holes or slots (not shown) can be formed through the cover to comply. This can be done without sacrificing the accidental discharge safety feature provided by the cover body.

It is advisable to follow certain installation precautions prior to simply mounting the present cover over an existing nipple. The very first is to be sure the weapon is not loaded. The installation procedures may vary with the particular form of cover arrangement being used. Any arrangement, however, requires that initial steps be taken to assure proper relationship of the cover to the cap.

In the "kit" form illustrated in FIG. 3, installation is accomplished by first removing the existing nipple from the firearm. Next, the modified nipple 20 is threaded into the cone seat 17 with the "O" ring 43 removed. Removal of the "O" ring allows access to the flattened surfaces of the nipple head 24 for the nipple wrench.

Prior to installation of the nipple, it may be advisable to apply a small portion of waterproof seal material to the nipple threads. This assures that water may not seep through the threads and into the firing chamber. After the nipple 20 is secured in place, the "O" ring can be fitted into its groove 47.

The above steps are not necessary if the self-sealing basic cover 32 is used (FIG. 2) or if the cover and integral seal means 42 is used. Both of these forms may be used with proper size standard nipples.

To test the safety feature of the present cover, the shooter will first place a cap over the nipple stem 21, after making sure again that the firearm is not loaded with powder or ball. He then places the cover 32 over the nipple and cap. The firearm is then pointed in a safe direction and the hammer snapped against the cover 32 several times. If the nipple has not been properly seated, the cap will discharge, making a clearly audible popping sound. If this happens, the cap is removed, along with the "O" ring 43 (if applicable) and the nipple is turned again until it seats firmly against the cone seat 17. The above procedure is then repeated. If caps continue to fire with the cover in place, the problem may be corrected by increasing the depth of the cover bore 34 until the closed top end 36 clears the cap 28. Proper spacing between the closed bore end 34 and the cap 28 will assure that there can be no accidental misfire. This feature, coupled with the hermetic sealing characteristics of the seal means 42 add a new dimension of safety and reliability to the sport of black powder shooting.

Installation and testing of the cover arrangement remains basically the same regardless of the form of cover or nipple arrangement being used. By using the present arrangement, the hunter can safely stalk game with his firearm in a fully cocked condition without fear that it may be accidentally discharged. If the trigger is pulled accidentally, the hammer will snap against the cover 32 and the impact force will be transmitted directly to the breech rather than to the cap 28. No discharge will result. Also, the cover prevents moisture from entering the cap and wetting the cap powder 29. Misfiring from damp caps is virtually eliminated.

The cover can be used quickly and efficiently with the thong 41 in place and tied at some convenient location such as the trigger guard 15. The cover is removed simply by pulling outwardly. The cover will slide quietly over the nipple and cap and can be dropped to swing by the thong 41 while the shooter takes aim and fires. Later, the cover can be replaced following replacement of the fired cap 28 with a fresh cap.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A protective nipple and cap cover for a percussion firearm having a breech and an exposed hammer thereon for forcibly striking a percussion cap mounted over the top end of a removable nipple threadedly engageable with the firearm breech, the cover comprising:

a rigid cover body defining a bore formed therein and extending from an open bottom end to a closed top end, to be received over the nipple and cap, with the closed top end between the cap and hammer and the open bottom end resting against the breech adjacent the nipple and with the closed top end spaced clear of the cap and nipple such that force of the hammer when striking is transmitted directly to the breech through the rigid cover body, clear of the cap and nipple to prevent unintentional discharge of the firearm; and seal means at the open bottom end of the bore for hermetically sealing the cap and nipple within the cover bore.

2. The protective cover of claim 1 wherein the seal means is comprised of a resilient "O" ring mounted between the cover body and nipple.

3. The protective cover of claim 1 wherein the seal means is comprised of a resilient "O" ring and wherein the cover body includes a groove for receiving the "O" ring and positioned thereon so the "O" ring will hermetically seal a cap and nipple within the cover body bore when the cover body is placed over the nipple with the open bottom end of the bore positioned adjacent the breech of the firearm.

4. The protective cover of claim 1 wherein the seal means is comprised of a resilient "O" ring adapted to be mounted to the nipple for slidably engaging and sealing against the rigid cover body as the open end thereof is placed over the nipple.

5. A percussion cap cover kit for percussion firearms having a hammer, a breech and a threaded nipple receiving fitting along the breech adjacent the hammer for receiving a nipple and a percussion cap, the cover kit comprising:

a nipple having a top end adapted to mount a percussion cap and a bottom threaded end adapted to be threadedly secured to the nipple receiving fitting on the breech of a percussion firearm with the cap spaced outward of the firearm breech by a prescribed distance;

a rigid cover body defining an interior bore extending from an open bottom end to a closed top end, slidably receivable over the nipple;

seal means between the nipple and rigid cover body for hermetically sealing the nipple top end within the bore of the rigid cover body; and wherein the threaded end of the nipple is adapted to secure the nipple to the fitting along the firearm breech, with the top end of the nipple projecting outwardly from the breech by a prescribed distance and wherein the distance along the rigid cover body from the open bore end to the closed end is greater than the prescribed distance.

6. The percussion cap cover kit of claim 5 wherein the seal means is comprised of a resilient "O" ring mounted within a groove formed in the nipple adjacent the threaded end thereof.

7. The percussion cap cover kit of claim 5 wherein the seal means is comprised of a resilient "O" ring mounted within a groove formed within the cover body for slidably engaging the nipple.

8. The percussion cap cover kit of claim 5 further comprising a rounded protrusion on the rigid body above the closed top end of the bore, adapted to be engaged by the firearm hammer.

9. The percussion cap cover kit of claim 8 further comprising a thong secured at one end to the rigid body and having a remaining end adapted for connection to the firearm.

10. A protective percussion cap cover for percussion firearms having a breech and an exposed hammer on the breech for movement in a swing path to discharge the firearm by striking a percussion cap fitted over a nipple threadably mounted to the breech, comprising:

a rigid cover body;

a bore defined within the cover body, extending from an open bottom end to a closed top end, the bore being of sufficient dimension to slidably be received over and to enclose the percussion cap and nipple, with the closed top end of the bore being spaced clear of the percussion cap in the swing path of the hammer and with the cover body at the open bottom end of the bore engaged against the firearm breech adjacent the nipple;

wherein the cover body is constructed of sufficiently rigid material to withstand impact of the hammer, deflecting the force thereof away from the cap; and further comprising:

seal means for hermetically sealing the percussion cap and nipple within the cover bore.

11. The protective cover of claim 10 further comprising a protrusion on the cover body adjacent the top closed end of the bore in the swing path of the hammer, for engagement by the hammer as it moves toward the cap and nipple.

12. The protective cover of claim 10 wherein the cover body is constructed of a malleable material, such as brass, to avoid damage to the hammer upon impact therewith.

* * * * *